US009140068B2

(12) United States Patent
Bauer et al.

(10) Patent No.: US 9,140,068 B2
(45) Date of Patent: Sep. 22, 2015

(54) UNDERWATER DRILLING ARRANGEMENT AND METHOD FOR MAKING A BORE

(75) Inventors: Thomas Bauer, Schrobenhausen (DE); Stefan Michael Finkenzeller, Reichershofen (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 259 days.

(21) Appl. No.: 13/592,319

(22) Filed: Aug. 22, 2012

(65) Prior Publication Data

US 2013/0048377 A1 Feb. 28, 2013

(30) Foreign Application Priority Data

Aug. 23, 2011 (EP) ..... 11006877

(51) Int. Cl.
*E21B 7/132* (2006.01)
*E21B 7/124* (2006.01)
*E21B 21/12* (2006.01)

(52) U.S. Cl.
CPC ..... *E21B 7/124* (2013.01); *E21B 21/12* (2013.01)

(58) Field of Classification Search
CPC ..... E21B 7/124; E21B 4/18; E21B 21/12
USPC ..... 175/5–10, 207; 166/358, 71; 405/228, 405/232, 249, 253; 37/317, 321, 324, 326, 37/330
See application file for complete search history.

(56) References Cited

U.S. PATENT DOCUMENTS

| | | | | | |
|---|---|---|---|---|---|
| 2,669,431 | A | | 2/1954 | Crowell | |
| 3,419,092 | A | | 12/1968 | Elenburg | |
| 3,958,651 | A | * | 5/1976 | Young | 175/340 |
| 4,042,048 | A | * | 8/1977 | Schwabe | 175/380 |
| 4,099,583 | A | | 7/1978 | Maus | |
| 4,244,431 | A | * | 1/1981 | Johnson | 175/320 |
| 4,255,068 | A | | 3/1981 | Valantin | |
| 4,630,691 | A | | 12/1986 | Hooper | |

(Continued)

FOREIGN PATENT DOCUMENTS

| | | | |
|---|---|---|---|
| CA | 1 137 122 | A | 12/1982 |
| CN | 101761311 | A | 6/2010 |

(Continued)

OTHER PUBLICATIONS

European Search Report dated Feb. 6, 2012 from corresponding European Patent Application No. EP 11 00 6877.

(Continued)

*Primary Examiner* — John Kreck
*Assistant Examiner* — Stacy Warren
(74) *Attorney, Agent, or Firm* — Studebaker & Brackett PC

(57) ABSTRACT

An underwater drilling arrangement for marking a bore in a bed of a lake, sea or river with a service platform which can be lowered for placing on the lake, sea or river bed, a drill drive which is mounted so that it is axially displaceable on the service platform, and a drill rod with drill head which can be driven in rotation via the drill drive. A conveying channel is formed in the drill rod, through which a conveying fluid together with excavated drill cuttings can be conveyed upwards, and a discharge opening for the conveying fluid together with the excavated drill cuttings is provided, via which the conveying fluid can be discharged underwater together with the excavated drill cuttings above the drill drive.

11 Claims, 2 Drawing Sheets

(56) References Cited

U.S. PATENT DOCUMENTS

| | | | | |
|---|---|---|---|---|
| 4,732,226 | A * | 3/1988 | Ebeling et al. | 175/94 |
| 4,744,698 | A | 5/1988 | Dallimer et al. | |
| 4,770,255 | A | 9/1988 | Barthelemy et al. | |
| 2009/0218136 | A1 | 9/2009 | Asakawa et al. | |
| 2010/0119309 | A1 * | 5/2010 | Gibberd | 405/228 |
| 2010/0314174 | A1 | 12/2010 | Denoix et al. | |
| 2011/0203848 | A1 * | 8/2011 | Krueger et al. | 175/57 |

FOREIGN PATENT DOCUMENTS

| | | | |
|---|---|---|---|
| DE | 2 154 231 | | 5/1973 |
| GB | 1 018 950 | | 2/1966 |
| JP | 04327685 | A * | 11/1992 |
| JP | H10-169354 | A | 6/1998 |
| JP | 2002-256788 | A | 9/2002 |
| JP | 2011-220015 | A | 11/2011 |
| KR | 2003-0008526 | A | 1/2003 |

OTHER PUBLICATIONS

Chinese Search Report issued by Chinese Patent Office on Jul. 16, 2014, which corresponds to Chinese Patent Application No. CN2012103927890 and is related to U.S. Appl. No. 13/592,319.

An Office Action; "Notice of Allowance," issued by the Korean Patent Office on May 20, 2014, which corresponds to Korean Patent Application No. 10-2012-0092376 and is related to U.S. Appl. No. 13/592,319.

The first Office Action including the Search Report issued by Chinese Patent Office on Jul. 16, 2014, which corresponds to Chinese Patent Application No. CN2012103927890 and is related to U.S. Appl. No. 13/592,319; English language translation.

An Office Action; "Notice of Allowance," issued by the Korean Patent Office on May 20, 2014, which corresponds to Korean Patent Application No. 10-2012-0092376 and is related to U.S. Appl. No. 13/592,319; with English language translation.

* cited by examiner

UNDERWATER DRILLING ARRANGEMENT AND METHOD FOR MAKING A BORE

FIELD OF THE INVENTION

The invention relates to an underwater drilling arrangement for making a bore in a bed of water body. The invention further relates to a method for creating a bore in a bed of a water body.

The underwater drilling arrangement comprises a service platform which can be lowered for placing on the bed of a lake, sea or river, a drill drive which is mounted to be axially displaceable on the service platform and a drill rod with drill head which can be driven in rotation via the drill drive.

In the method for making a bore in a bed of a lake, sea or river, a service platform of the underwater drill arrangement is lowered onto the bed of the lake, sea or river and placed with bottom standing elements on the bed of the lake, sea or river and a drill rod with drill head is driven in rotation via a drill drive which is mounted on the service platform.

The underwater drilling arrangement and the drilling method serve in particular for the creation of foundations or foundation piles in the bed of a lake, sea or river, for example for anchoring offshore wind power plants, flow turbines of tidal power plants or oil and gas conveying units in the sea.

BACKGROUND OF THE INVENTION

With known underwater drilling arrangements and methods for creating a bore in a bed of a lake, sea or river, released drilling cores are discontinuously retrieved from the bore. The corresponding drilling methods thereby require great resources and are time-intensive.

SUMMARY OF THE INVENTION

It is the object of the invention to facilitate an underwater drilling arrangement and a method for creating a bore in a bed of a water body which facilitate a particularly economic creation of an underwater bore.

The object is achieved according to the invention through an underwater drilling arrangement and a method for making a bore in a bed of a water body.

The underwater drilling arrangement according to the invention is characterised in that a conveying channel is formed in the drill rod, through which a conveying fluid can be conveyed upwards together with excavated drill cuttings and a discharge opening for the conveying fluid together with the excavated drill cuttings is provided, via which the conveying fluid can be discharged underwater together with the excavated drill cuttings above the drill drive.

The method according to the invention which can be carried out in particular with an underwater drilling arrangement according to the invention is characterised in that excavated drill cuttings are conveyed upwards together with a conveying fluid through a conveying channel in the drill rod and discharged underwater via a discharge opening above the drill drive.

A first core idea of the invention can be seen in that an underwater bore is continuously to be created, wherein the excavated earth material is conveyed upwards out of the bore via an induced fluid flow inside the drill rod. The drill rod is hereby designed as a hollow drill rod. The conveying fluid can be in particular water from the lake, sea or river, in the bottom of which the bore is created.

A second core idea of the invention is that conveying fluid is conveyed with the excavated drill cuttings into a region above the drill drive and in particular above the bed of the lake, sea or river and discharged there into the surrounding water. The excavated drill cuttings then sediment on the bed of the lake, sea or river in the environment of the bore created. The discharge opening is hereby found in the water, above the drill drive.

A fundamental aspect of the underwater drilling arrangement according to the invention and the corresponding method accordingly consists in that the excavated earth material is not conveyed to the water surface and retrieved but instead is discharged into the water itself.

The service platform of the underwater drilling arrangement can preferably be lowered via a cable from a support means, in particular a vessel or a floating platform, onto the bed of a lake, sea or river. By means of a so-called umbilical the service platform is connected during operation for supply of energy and/or fluid, for example a hydraulic fluid for driving the drill drive, to the vessel or floating platform. After creation of the bore the service platform can be raised again via the cable and removed from the bed of the lake, sea or river. In order to lower and retrieve the service platform a cable winch can be provided on the ship or the floating platform.

According to a preferred embodiment the drill rod is guided through the drill drive. The conveying fluid can thus be conveyed through the drill drive upwards and into the water. The drill drive can be configured in particular as a rotary table which surrounds the drill rod.

In order to eject the excavated drill cuttings at a certain height above the drill drive an ejection line is preferably arranged above the drill drive. The ejection line is fluidically connected to the conveying channel of the rotatable drill rod and runs above the bed of a lake, sea or river and preferably at a predefined minimum height above the service platform into the water. The ejection line is preferably rotationally decoupled from the rotatable drill rod via a rotary coupling. For even discharge of the excavated drill cuttings irrespectively of the rotation movement of the drill rod it is preferable for the ejection line to be mounted on the service platform. The ejection line is preferably formed as a rigid line which extends upwards from the drill drive.

According to the invention it is preferable that the drill drive can be lowered along the service platform into the bore. In order to facilitate—even when the drill drive and drill rod are lowered into the bore—an ejection of the excavated drill cuttings above the bed of the lake, sea or river, it is advantageous that the ejection line is telescopically designed.

In the course of the drilling process, therefore, the ejection line can be extended upwards in order to eject the excavated drill cuttings above the bed of the lake, sea or river and/or above the service platform.

According to a further preferred embodiment of the invention it is provided that the ejection line comprises an elbow which deflects in a lateral direction the conveying fluid with the drill cuttings removed for ejection at an, especially laterally, offset position relative to the drill rod. The discharge opening is hereby preferably laterally offset beside the bore to be created so that the removed drill cuttings can be expelled laterally beside the service platform.

It is particularly preferable according to the invention that the ejection line is mounted so that it can be rotated for a targeted discharge of the drill cuttings in a certain direction relative to the drill rod and/or the drill drive and/or the service platform and in particular can be rotated in dependence upon a water flow. Preferably a flow lug is connected to the ejection line which rotates the ejection line in dependence upon the water flow. It can hereby be purposefully ensured that the excavated drill cuttings are constantly discharged in a desired direction, in particular in the direction of a water flow and not against this. The excavated drill cuttings can thus be prevented from flowing after discharge back into the direction of the service platform and damaging it.

A back-flow or an undesired penetration of foreign bodies in the conveying channel can be prevented by a non-return valve being arranged in the region of the discharge opening.

Furthermore it is preferred according to the invention that in order to generate an upwardly orientated flow in the conveying channel along the drill rod a feed channel for a compressed gas is provided, from which the compressed gas can be fed back to the conveying channel. The compressed gas can be blown in via feed openings or blow-in nozzles from the feed channel into the conveying channel in order to bring about an upwardly orientated flow there. The compressed gas can also be directly introduced into the drill head, from which it flows into the conveying channel. The compressed gas generates in the conveying channel a three-phase mixture of liquid conveying fluid, gas and drill cuttings which has a lower density than the water surrounding the drill rod in the bore. An upward flow is hereby generated in the conveying channel.

In order to feed compressed gas into the feed channel provided on the drill rod it is preferable for a feed line to be provided which connects the feed channel to a conveying unit at the water surface of the lake, sea or river, in particular a compressor. The feed line for the compressed gas can be arranged in particular in the so-called umbilical which contains energy lines for driving the drill drive.

A further possibility for generating an upwardly orientated flow in the conveying channel consists in that a pump, in particular a suction pump and/or a jet pump, is/are provided. The pump can for example be arranged above the drill drive in the region of the service platform. In case of a suction pump the conveying fluid flows together with the drill cuttings through the pump. In particular the jet pump can also be arranged in the region of the drill head, in particular therein, and be supplied with fuel via a fuel line guided along the drill rod. The conveying fluid can be fed to the conveying channel either via the feed channel or via the annular space between the drill rod and bore edge.

According to a preferred embodiment of the invention the drill rod is formed as a double pipe, in which the conveying channel and a feed channel for the conveying fluid and/or a compressed gas are formed. The feed channel preferably extends annularly around a central conveying channel.

In order to suck in the released drill cuttings it is preferable for the drill head to comprise a suction chamber which is fluidically connected to the conveying channel and the feed channel. The suction effect is hereby produced through the upwardly orientated flow in the conveying channel. The suction chamber preferably comprises an upwardly orientated opening which is preferably located in the region of a drilling tool of the drill head. The drill cuttings can hereby be removed directly after release from the bottom of the bore.

A particularly effective removal of the released drill cuttings from the bore bottom can be achieved in that the feed channel comprises a lower outlet opening which opens radially outwards into the suction chamber and generates there a radially outwardly orientated flow and in that the suction chamber comprises deflection means which generate a deflection of the radially outwardly orientated flow into a radially inwardly orientated flow which carries along excavated drill cuttings in the direction of the conveying channel. The drill head, in particular the suction chamber, is formed preferably in the form of a bell shape so that the desired flow can be adjusted due to the bell-shaped profile of the suction chamber. The radially inwardly orientated flow is in particular directly above the bore bottom so that the excavated drill cuttings are conveyed radially inwardly into a central region of the drill head, in which the inlet of the conveying channel is located.

In order to guide the drill drive along the service platform it is preferable for the service platform to comprise a guide tube, along which the drill drive is guided so that it can be axially moved. The guide tube is preferably held so that it can be adjusted and fixed in a mount of the service platform.

The guide tube thus assumes quasi the function of an intermediary, along which the drill drive is guided so that it can be moved. Furthermore the drill drive arranged and guided inside the guide tube is extensively protected against external influences such as flows of the water.

In order to guide the drill drive, the guide tube preferably comprises a linear guide extending in axial direction which cooperates with a guide element of the drill drive.

The guide tube is preferably mounted in such a way that it can be moved axially or rotated in a mount of the service platform so that the guide tube can be moved during the creation of the bore, in particular can be lowered and raised or rotated. Furthermore the guide tube can be fixed to the mount so that it is secured against a rotary movement and/or an axial movement relative to a base body of the service platform.

The fixed guide tube can serve during operation of the drill drive as an abutment or support for the drill drive. Furthermore the guide tube can be subsequently supplied, due to its adjustable mounting on the base body of the service platform, in the drilling direction in order to extend the guiding of the drill drive downwards. In particular the guide tube itself, in particular rotating, can be incorporated into the bed of a lake, sea or river. For this purpose a guide tube drive is provided. The drill drive can also be introduced along the guide tube into the bed of a lake, sea or river or the bore.

The whole service platform can be raised again after creation of the bore and removed from the bed of the lake, sea or river.

BRIEF DESCRIPTION OF THE DRAWINGS

The invention is described in greater detail below using preferred exemplary embodiments which are shown in the attached drawings in which.

Equivalent elements are identified in all the figures with the same reference numerals.

DETAILED DESCRIPTION OF THE DRAWINGS

Figure 1:
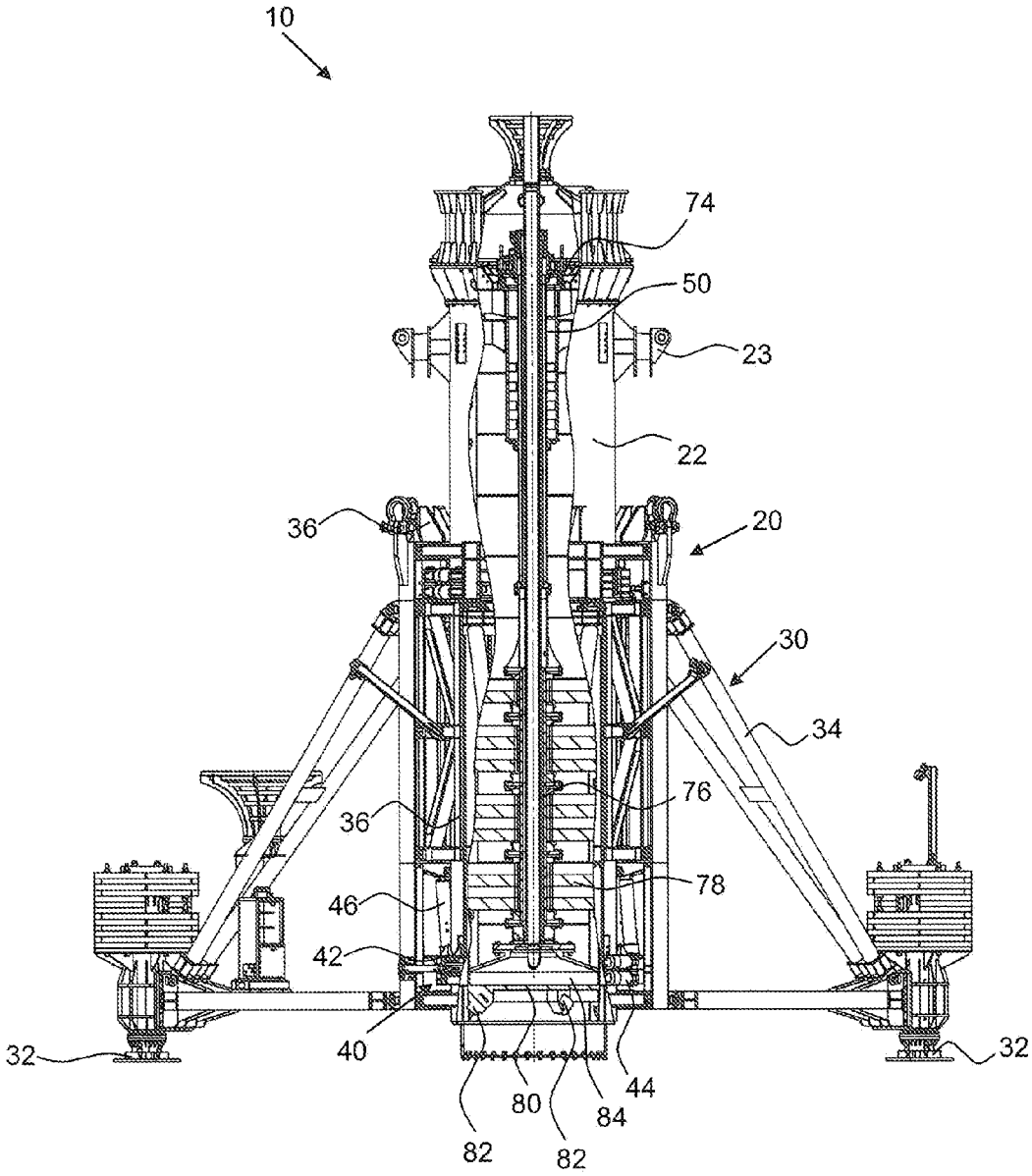
FIG. 1 shows a side view of an underwater drill arrangement.

FIG. 1 shows an underwater drilling arrangement 10 according to the invention with a service platform 20 which can be placed on a bed of a water body, like a lake, sea or river and a drill drive 50 guided and mounted on the service platform 20. The service platform 20 comprises a base body 30 which can also be described as a base frame and a guide tube 22 for guiding the drill drive 50.

The base body 30 comprises a plurality of bottom standing elements 32 for standing on the bed of a lake, sea or river. The bottom standing elements 32 area preferably designed to be adjustable so that unevenness in the bed of the lake, sea or river can be compensated and the service platform 20 can be erected in the desired orientation, in particular horizontally, on the bed of the lake, sea or river. The base body 30 further comprises a plurality of struts 34 and a central mount 36 for the guide tube 22. The guide tube 22 is mounted so that it can be adjusted in the mount.

In order to rotate the guide tube 22 relative to the base body 30 a rotary drive 40 is provided on the base body 30 of the service platform 20. The rotary drive 40 comprises a hydraulically clampable collet 42 which can be rotated by means of a horizontal cylinder 44. In order to apply a vertical force to the guide tube 22 an axial drive, in particular a vertical cylinder 46, is further provided.

The guide tube 22 comprises a cutting means 28 with a plurality of cutting teeth at its lower end for easier screwing into the bed of a lake, sea or river. A plurality of securing elements 23 for securing the guide tube 22 relative to the base body 30 are arranged on the outer periphery of the cylindrical guide tube 22.

Inside the guide tube 22 the drill drive 50 is arranged which can be introduced via a cable (not shown) into the guide tube 22. The drill drive 50 which can also be described as a rotary drive drives a drill rod 60, on the lower end of which a drill head 80 with drill tools 82 is arranged. The drill drive 50 is mounted so that it can be axially moved in the guide tube 22 and can be tensioned in the guide tube 22. A line 12 which can be described in particular as an umbilical serves for supplying the drill drive 50 with hydraulic fluid.

A linear guide 24 is formed on an inner wall of the guide tube 22, along which linear guide 24 the drill drive 50 is axially guided. The advancing movement of the drill rod 60 with the drill head 80 can be achieved in particular through gravity. In order to increase the load on the drill head 80, load plates 78 are arranged on the drill rod 60 above the drill head 80, in particular on a drill collar 76 of the drill rod 60. The load plates 78 comprise a central passage for the drill rod 60 and are arranged in particular releasably on the drill rod 60. They extend extensively over the whole cross-section of the guide tube 22.

In addition to the advancing movement through gravity an advancing means, in particular a feed cylinder, can be provided on the drill drive 50 which controls the load on the drill head 80.

The hollow drill rod 60 comprises a central conveying channel 62 and an annularly surrounding feed channel 66. The drill rod 60 is driven in rotation by the drill drive 50 and extends axially through the drill drive 50. Above the drill drive 50 an ejection line 68 with a discharge opening 69 is attached to the drill rod 60 via a coupling means 70 and fluidically connected to the conveying channel 62.

The ejection line 68 extends upwards and can include an elbow (not shown) which laterally deflects the conveying fluid with the drill cuttings. The discharge opening 69 is hereby preferably arranged to the side of the service platform 20 so that the discharge of the drill cuttings takes place beside the service platform 20.

The flow in the conveying channel 62 can be produced in a different way. For example an air lifting process can be used. By means of the feed channel 66 a gas, for example compressed air, can be downwardly conveyed and introduced via blow-in openings 64 or nozzles into the conveying channel 62, so that the density of the conveying fluid in the conveying channel 62 is reduced and an upwardly orientated flow is produced. The gas can be fed via a feed line 58, in particular the umbilical 12, from the support unit on the water surface.

Figure 2:
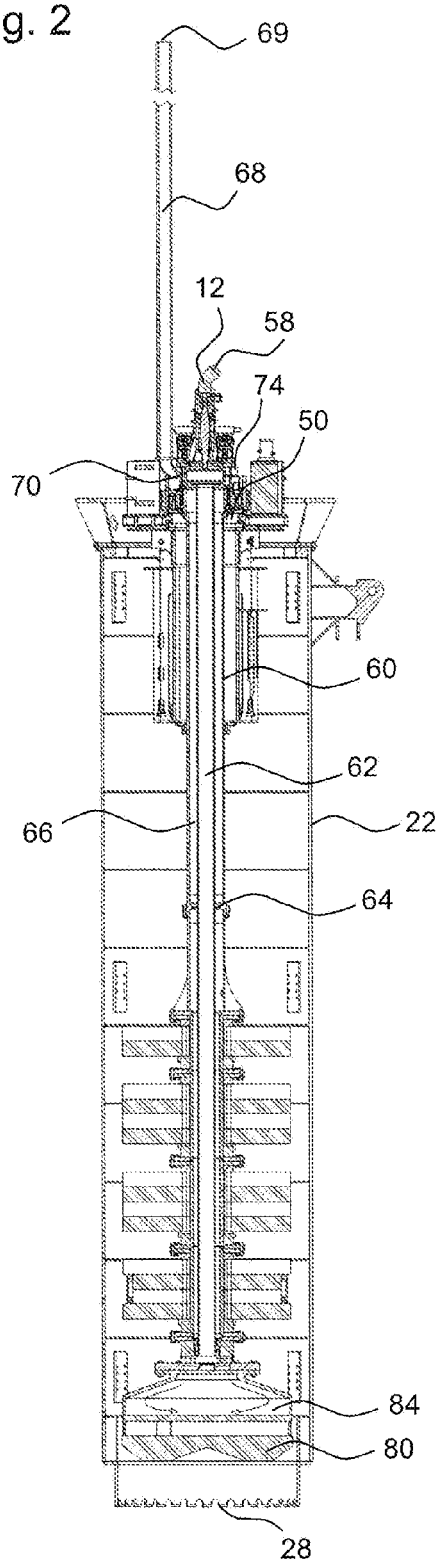
FIG. 2 shows a cross-sectional view of a drill unit with drill drive arranged in a guide tube.
Figure 3:
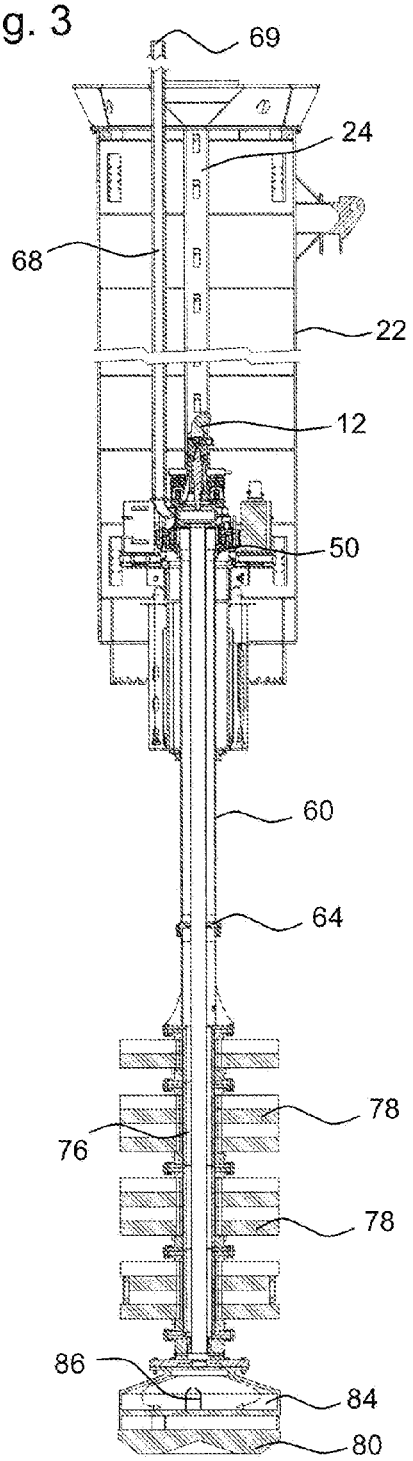
FIG. 3 shows a drill unit downwardly moved in a guide tube.

Alternatively or additionally the flow can be produced in the conveying channel 62 also by means of a pump. For example a suction or displacement pump 74 can be arranged above the drill drive 50, as indicated in FIGS. 2 and 3. The suction or displacement pump 74 sucks the conveying fluid in the conveying channel 62 and thus produces an upwardly orientated flow in the conveying channel 62. The pump 74 conveys the conveying fluid together with the drill cuttings in the ejection line 68.

Alternatively or additionally a jet pump 86 can be provided to generate the upwardly orientated flow in the guide channel 62. The jet pump 86 can also be disposed above the drill drive 50 or, as schematically shown in FIG. 3, in the region of the drill head 80, in particular within a suction chamber 84 of the drill head 80 which is described in greater detail below. The jet pump 86 is supplied with fuel by means of a fuel line (not shown).

The suction chamber 84 is fluidically connected to the feed channel 66 and the conveying channel 62. The feed channel 66 comprises at its lower end an outlet opening, via which a fluid, for example water or air, can be introduced into the suction chamber 84 in such a way that a flow is produced there which carries along the released drill cuttings radially inwards. In a central region of the suction chamber 84 the released drill cuttings are upwardly drawn through the upwardly orientated flow in the conveying channel 62.

Below, an inventive drilling method for producing a bore in a bed of a lake, sea or river is described.

Initially the service platform 20 including guide tube 22 is lowered by means of a cable (not shown) from a support means arranged on the water surface, for example a floating platform or a vessel, and erected on the bed of a lake, sea or river. The service platform 20 is then orientated and can additionally be fixed to the bottom.

After the service platform 20 has been arranged in the desired orientation on the lake, sea or river bed, a drilling unit is introduced with a drill drive 50, a drill rod 60 and a drill head 80 into the guide tube 22. The drill rod 60 is driven in rotation by the drill drive 50. Through the progress of the drilling the drill drive 50 travels along the guide tube 22 downwards. As soon as the drill drive 50 has reached the lower end of the guide tube 22, the guide tube 22 can be bored along the bore created, wherein the drill drive 50 moves again in the direction of the upper end of the guide tube 22. The drill drive 50 can then be moved downwards again along the guide tube 22, whereby earth material is excavated again. The drill drive 50 can thus be bored in the guide tube 22 of the service platform 20 into the bore created.

The excavated earth material is conveyed upwards by means of an upwardly orientated flow generated in the conveying channel 62 and discharged into the water by means of a discharge opening 69.

The upwardly orientated flow in the conveying channel 62 can be produced in different ways. For example a gas, in particular air, can be blown into the conveying channel so that the density of the conveying fluid in the conveying channel 62 is reduced and thus an upwardly orientated flow is produced. Alternatively or additionally it is possible to pump the conveying fluid upwards in the conveying channel 62, whereby this can be brought about for example by a suction pump 74 or a jet pump 86. The pump can be supplied with hydraulic fluid or fuel through the so-called umbilical which connects the underwater drilling arrangement 10 with the support means provided at the water surface. The air to be introduced into the conveying channel 62 is also provided preferably from above the water surface via the umbilical.

The invention claimed is:

1. An underwater drilling arrangement for making a bore in a bed of a water body, said underwater drilling arrangement comprising a service platform which is lowered for placing on the bed of the water body, the service platform including a base body, a guide tube adjustably mounted on the base body, the guide tube being axially displaceable with respect to the base body, the guide tube being rotatably drivable via a guide tube drive for screwing the guide tube into the bed of the water body, a drill drive adjustably mounted and guided in the guide tube, the drill drive being axially displaceable with respect to the guide tube, a drill rod with drill head being rotatably driven via the drill drive, wherein the drill rod extends through the drill drive and is located centrally with respect to the guide tube and the drill drive, a conveying channel formed in the drill rod, through which a conveying fluid is conveyed upwards together with excavated drill cuttings, a discharge opening for the conveying of the conveying fluid together with the excavated drill cuttings via which the conveying fluid is discharged underwater together with the excavated drill cuttings above the drill drive, the drill rod being a double pipe, in which the conveying channel for conveying excavated drill cuttings upward and a feed channel for feeding the conveying fluid are formed, and an ejection line located above the drill drive, the ejection line being attached to the drill rod by a coupling for fluid connection to the conveying channel, the ejection line having a discharge opening for release of excavated drill cuttings from the drill rod.

2. The underwater drilling arrangement according to claim 1, wherein the drill rod is guided through the drill drive.

3. The underwater drilling arrangement according to claim 1, wherein the ejection line has an elbow which deflects the conveying fluid with the excavated drill cuttings for lateral ejection relative to the drill rod.

4. The underwater drilling arrangement according to claim 1, wherein the ejection line is rotatably mounted relative to the drill rod and/or the drill drive and/or the service platform.

5. The underwater drilling arrangement according to claim 1, wherein in order to generate an upwardly orientated flow in the conveying channel along the drill rod, a feed channel for a compressed gas is provided, from which the compressed gas can be fed to the conveying channel.

6. The underwater drilling arrangement according to claim 5, wherein a feed line is provided which connects the feed channel to a water surface of the water body.

7. The underwater drilling arrangement according to claim 1, wherein in order to generate an upwardly orientated flow in the conveying channel, a pump is provided.

8. The underwater drilling arrangement according to claim 1, wherein the drill head comprises a suction chamber which is fluidly connected to the conveying channel and the feed channel.

9. The underwater drilling arrangement according to claim 1, wherein the feed channel includes a lower outlet opening which opens radially outwardly into a suction chamber and produces a radially outwardly orientated flow therein, and the suction chamber generates a deflection of the radially outwardly orientated flow into a radially inwardly orientated flow which carries along the excavated drill cuttings in a direction of the conveying channel.

10. Method for making a bore in the bed of a water body with an underwater drilling arrangement according to claim 1, wherein the service platform of the underwater drilling arrangement is lowered onto the bed of the water body and placed with bottom standing elements on said bed of the water body, and the drill rod with drill head is driven in rotation via the drill drive which is mounted on the service platform, wherein excavated drill cuttings together with the conveying fluid are upwardly conveyed through the conveying channel in the drill rod and discharged underwater via the discharge opening above the drill drive.

11. The underwater drilling arrangement according to claim 1, wherein the feed channel extends annularly around the conveying channel and the conveying channel is centrally located.

* * * * *